US008062540B2

(12) United States Patent
Sugimoto et al.

(10) Patent No.: US 8,062,540 B2
(45) Date of Patent: Nov. 22, 2011

(54) LOW-VOC LEATHER

(75) Inventors: Masahiko Sugimoto, Nikaho (JP); Naoko Abe, Yamagata (JP); Tatsuaki Ujiie, Yamagata (JP); Shinji Kashiwagura, Yamagata (JP)

(73) Assignee: Midori Hokuyo Co., Ltd, Yamagata (JP)

( * ) Notice: Subject to any disclaimer, the term of this patent is extended or adjusted under 35 U.S.C. 154(b) by 0 days.

(21) Appl. No.: 12/810,665

(22) PCT Filed: Dec. 26, 2008

(86) PCT No.: PCT/JP2008/004033

§ 371 (c)(1), (2), (4) Date: Jun. 25, 2010

(87) PCT Pub. No.: WO2009/084236

PCT Pub. Date: Jul. 9, 2009

(65) Prior Publication Data

US 2010/0281622 A1 Nov. 11, 2010

(30) Foreign Application Priority Data

Dec. 28, 2007 (JP) ..... 2007-340943

(51) Int. Cl.
*C14C 9/00* (2006.01)

(52) U.S. Cl. ..... 252/8.57; 297/219

(58) Field of Classification Search ..... 8/94.15, 8/94.18, 94.19 R; 252/8.57; 297/219
See application file for complete search history.

(56) References Cited

U.S. PATENT DOCUMENTS

| | | | | |
|---|---|---|---|---|
| 4,256,809 | A * | 3/1981 | Larsson et al. | 428/473 |
| 5,376,142 | A | 12/1994 | Matthews et al. | |
| 6,022,383 | A * | 2/2000 | Kuwabara et al. | 8/436 |
| 2006/0141236 | A1 | 6/2006 | Nakamura et al. | |

FOREIGN PATENT DOCUMENTS

| | | | | |
|---|---|---|---|---|
| EP | 0994195 | A | | 4/2000 |
| JP | H02-004607 | A | | 1/1990 |
| JP | H06-080619 | A | * | 3/1994 |
| JP | H06-502886 | A | | 3/1994 |
| JP | H08-232000 | A | | 9/1996 |
| JP | H09-078452 | A | | 3/1997 |
| JP | H10-102782 | A | | 4/1998 |
| JP | H11-022206 | A | | 1/1999 |
| JP | H11-046965 | A | * | 2/1999 |
| JP | 2000-119700 | A | * | 4/2000 |
| JP | 3053373 | B | * | 6/2000 |
| JP | 2003-277411 | A | * | 10/2003 |
| JP | 2005-272725 | A | | 10/2005 |
| JP | 2005-325225 | A | * | 11/2005 |
| JP | 2006-008723 | A | | 1/2006 |
| JP | 2006-182825 | A | * | 7/2006 |
| JP | 2006-188669 | A | * | 7/2006 |
| JP | 2006-321880 | A | * | 11/2006 |
| JP | 2006-321929 | A | | 11/2006 |
| JP | 2007-070487 | A | | 3/2007 |
| JP | 2007-084527 | A | * | 4/2007 |
| JP | 2007-167495 | A | * | 7/2007 |
| WO | 93/06249 | A | | 4/1993 |

OTHER PUBLICATIONS

Yoshimura, et al., Studies on Hormaldehyde in Leathers and Leather Goods (2) Examination of Methods for Removing Extractable Formaldehyde From Leathers, Hikaku Kagaku (Leather Chemistry), Feb. 1989, p. 177, vol. 34, No. 4, Japanese Association of Leather Technology, Tokyo Noko University, Fuchu-shi, Tokyo, Japan.

* cited by examiner

*Primary Examiner* — Amina Khan
(74) *Attorney, Agent, or Firm* — Law Office of Katsuhiro Arai

(57) ABSTRACT

A natural leather is treated with a tanning agent, a re-tanning agent, a dye and a greasing agent, wherein a treatment agent for inhibiting the generation of formaldehyde and acetaldehyde from the natural leather is added to the greasing step so that the natural leather is impregnated with the treatment agent. The treatment agent includes a hydrazide compound optionally together with sodium hydrogen sulfite.

14 Claims, 2 Drawing Sheets

[FIG.1]
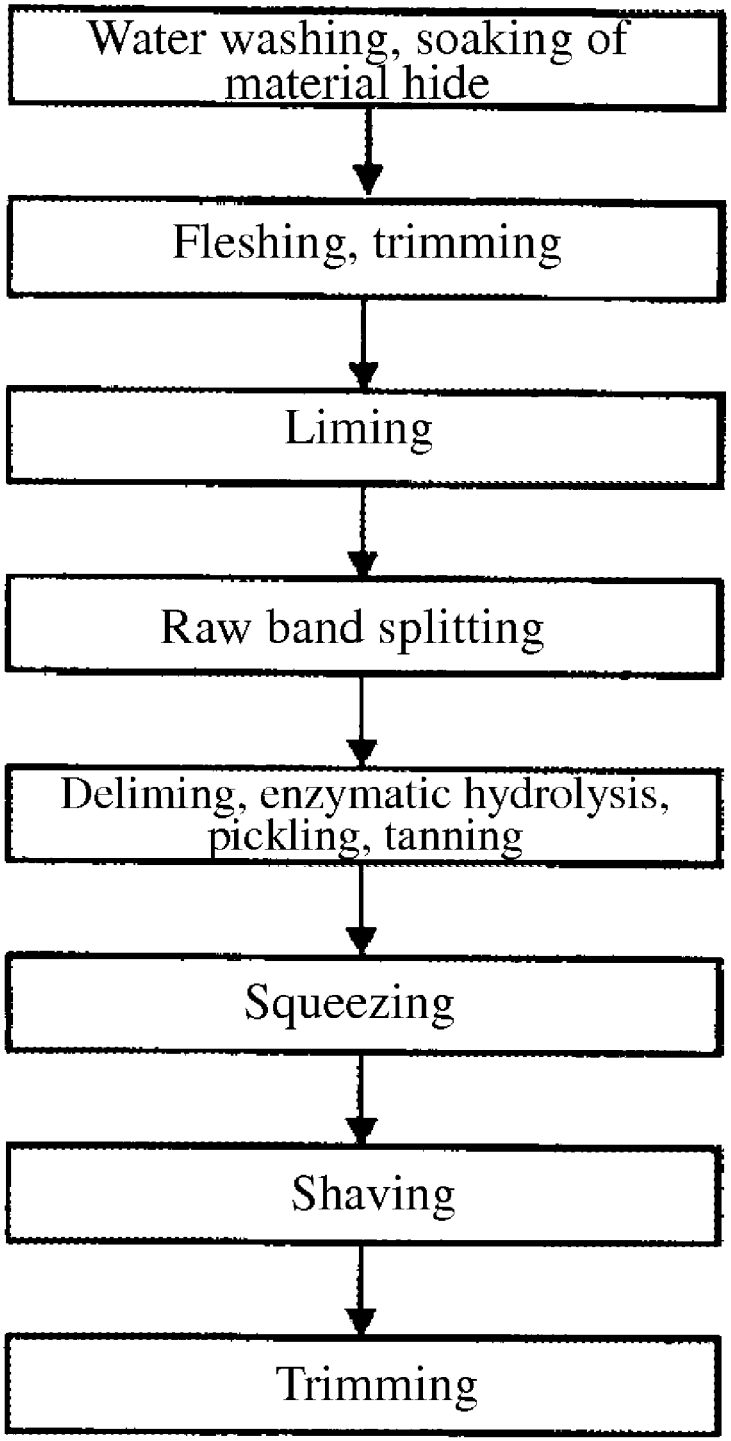

[FIG.2]
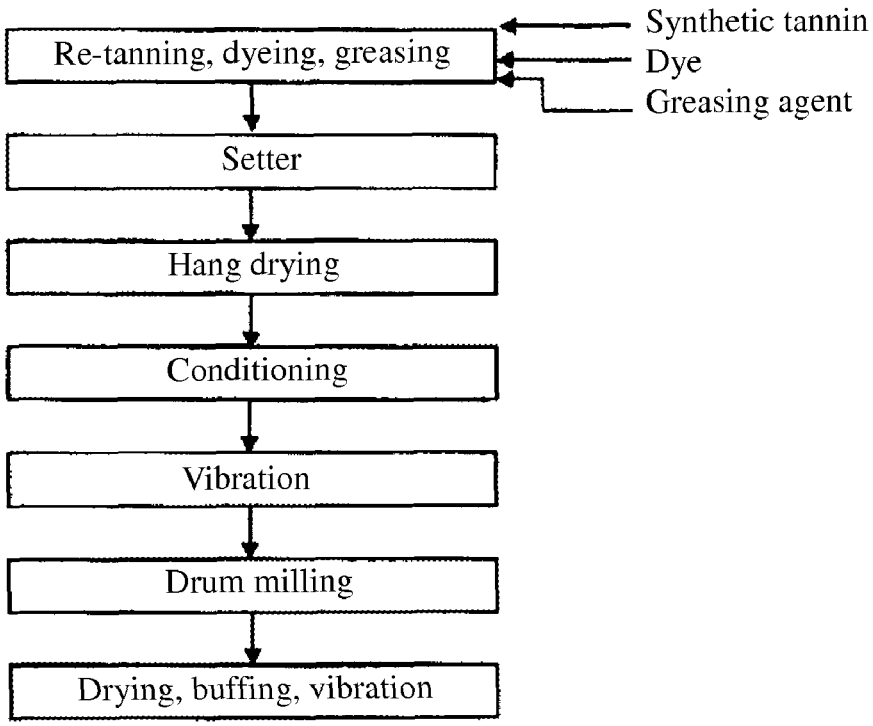
[FIG. 3]
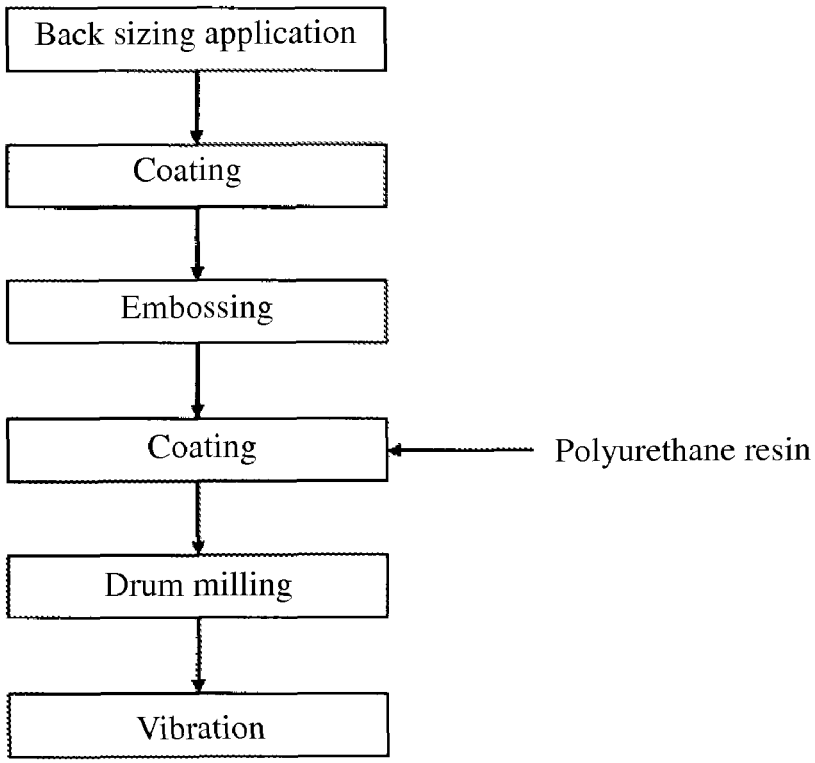

LOW-VOC LEATHER

This application is the U.S. National Phase under 35 U.S.C. §371 of International Application PCT/JP2008/004033, filed Dec. 26, 2008, which claims priority to Japanese Patent Application No. 2007-340943, filed Dec. 28, 2007. The International Application was published under PCT Article 21(2) in a language other than English.

TECHNICAL FIELD

The present invention relates to a natural leather associated with low volatilization volumes of VOCs (volatile organic compounds) (hereinafter also referred to as "low-VOC leather"; the terms "leather", "leather skin", and "natural leather" are hereinafter used synonymously).

PRIOR ART

Seats, steering wheels, shift knobs, instrument panels and other automobile interior parts use natural leathers.

The process of manufacturing a natural leather from a natural hide comprises a pre-treatment step before tanning, a tanning step where a tanning agent is used, a re-tanning step where again a tanning agent is used, a dyeing step where a dye is used, a greasing step where a greasing agent is used, a drying step, and a coating film-forming step. When implementing this series of steps, it is possible to complete the tanning step and successively perform the re-tanning and subsequent steps, or move to a different location to perform the re-tanning and subsequent steps there.

In the tanning step, chromium compounds have been used as tanning agents. However, the current trend is to switch to methods where tanning agents constituted by glutaraldehyde and other materials other than chromium compounds are used.

In the re-tanning step, re-tanning is performed using chromium compounds, or using other types of re-tanning agents such as vegetable tanning agents, synthetic tanning agents and glutaraldehyde.

As for dyes, various dyes are used including acid dyes having a sulfonic acid group or carboxylic acid group, direct dyes having the sulfonic acid group, basic dyes having a nitrogen base, reactive dyes, and sulfur dyes.

As for greasing agents, anionic greasing agents, cationic greasing agents, amphoteric greasing agents, nonionic greasing agents and fatty acid soaps are used, among others.

After the greasing step and subsequent drying step, a coating material is applied onto the leather to form a coating film. Polyurethane resin and other synthetic resins are used in the forming of coating film.

Natural leathers manufactured by the aforementioned process are used as covering materials for automobile interior parts, etc. Natural leathers having unique characteristics such as wear resistance and favorable touch can be obtained. Needless to say, automobile interior parts using leathers have been developed under strict control conditions. When the cabin environment of automobiles fitted with such automobile interior parts was measured, however, formaldehyde, acetaldehyde and other VOCs (volatile organic compounds) were detected, indicating that these compounds were present in air in the cabin of these automobiles.

The Japan Automobile Manufacturers Association is working to make sure VOC concentrations in automobile cabins meet the guideline values set by the Ministry of Health, Labour and Welfare, and accordingly automakers and natural leather manufacturers are doing their best to bring VOC concentrations in automobile cabins to compliance with the guideline values.

Reasons why the aforementioned VOCs generate or specific mechanisms of their generation are not yet understood fully and no specific methods are available, either, to minimize the amounts of formaldehyde, acetaldehyde, etc., in automobile cabins to the target values or below, and accordingly the market is awaiting effective solutions to be developed as soon as possible.

Natural leathers used in automobile cabins, manufactured from animal hides, are known to be exposed to extremely high temperatures, much higher than the temperatures in normal living spaces, when the automobile is left under the direct sun with all its windows closed. When this occurs, volatile components in materials volatilize at these high temperatures, attach to the glass surface where they are cooled and condense again, and these deposits of re-condensates cause the window glass to fog. The fogged glass obstructs the driver's view and reduces driving safety. This phenomenon is called "fogging." Fogging occurs due to volatilization of volatile components at high temperatures (100 to 120° C.), and is different from the problem dealt with by the present invention which is caused by formaldehyde, acetaldehyde, etc., generated in the cabin environment even when not heated.

Methods to reduce the generation of formaldehyde, acetaldehyde, etc., in automobile cabins include those listed below. Because tanning agents used in the tanning step are cited as a cause of formaldehyde generation, tanning agents that do not generate formaldehyde, such as those using hydroxyalkylphosphine compounds, are being developed (Patent Literature 1, Published Japanese Translation of PCT International Patent Application No. Hei 6-502886; Patent Literature 2, Japanese Patent Laid-open No. 2005-272725; and Patent Literature 3, Japanese Patent Laid-open No. 2006-8723).

Currently, obtaining synthetic tanning agents from phenolsulfonic acid and formaldehyde is considered the most appropriate approach (Patent Literature 4, Japanese Patent Laid-open No. 2000-119700). However, tanning and re-tanning using these newly developed tanning agents mentioned above is not considered as effective as the results achieved by conventional tanning and re-tanning treatments, and therefore this approach does not provide a sufficient solution. Also, this approach does not touch on prevention of another problem currently debated, or specifically volatilization of residual acetaldehyde from natural leathers, and therefore this approach is not expected to offer a fundamental solution at the present.

A method is known that comprises the first step where the target leather is tanned without using formalin, and the second step where the aforementioned leather completing the aforementioned first step is tanned with oil in a rotary drum and the temperature in the aforementioned rotary drum is gradually raised to oxidize the leather in the aforementioned rotary drum (Patent Literature 5, Japanese Patent Laid-open No. 2005-272725). Here, formalin-free tanning is performed using glutaraldehyde, and since the methods presenting problems today do not use glutaraldehyde, the aforementioned method cannot be used to deal with formaldehyde and acetaldehyde presenting problems today.

Currently no effective methods are available that offer an immediate solution to the challenge of reducing/preventing generation of formaldehyde or acetaldehyde from within natural leathers that are manufactured by a series of steps including tanning operation, and the market is awaiting effective solutions to be developed as soon as possible.

Methods to remove formaldehyde and acetaldehyde, which are used in areas other than manufacturing of natural leathers, include the following:

(1) In manufacturing processes where the chemical reaction produces formaldehyde or acetaldehyde byproducts, methods to inhibit generation amounts to certain levels or return the finally isolated formaldehyde and acetaldehyde back to the reaction system and thereby keep generation amounts constant at all times are used more often than methods to remove all formaldehyde or acetaldehyde byproducts from the system and thereby eliminate formaldehyde and acetaldehyde in the final product.

(i) Methods to remove formaldehyde and acetaldehyde byproducts generated in propyleneoxide include recycling formaldehyde and acetaldehyde byproducts and putting recycled byproducts back into the system, and in some cases formaldehyde and acetaldehyde are removed from the system together with water (Patent Literature 6, Japanese Patent Laid-open No. 2007-84527).

(ii) In the manufacture of ethylene vinyl acetate emulsion, an inorganic reducing agent is added to the reaction system beforehand to prevent generation of acetaldehyde and other aldehydes (Patent Literature 7, Japanese Patent Laid-open No. 2003-277411).

Under this method, however, the reaction targeting formaldehyde and acetaldehyde byproducts generated in the system continues and there is no mention of any method that can be used to prevent generated formaldehyde and acetaldehyde from leaking out of the natural leather, and therefore this method does not provide a solution.

(2) If formaldehyde or acetaldehyde contained in a product or generating from a high-molecular compound by means of breakdown scatters into air, an additive that traps formaldehyde and acetaldehyde in the product is added in an initial stage of manufacturing the product in order to prevent formaldehyde and acetaldehyde from generating as a result of breakdown, etc. To be specific, in the stage of manufacturing a molding from a plastic molding material used for automobile interior parts, such as polyurethane foam molding, resin powder for slash molding or polyacetal resin composition molding, either carbohydrazide or acetic acid hydrazide, or adipic acid dihydrazide, aromatic carboxylic acid hydrazide, 1,2,3,4-butanetetracarboxylic acid hydrazide, etc., may be added to all areas of the product, including the interior and exterior (Patent Literature 8, Japanese Patent Laid-open No. 2006-182825; Patent Literature 9, Japanese Patent Laid-open No. 2006-188669; Patent Literature 10, Japanese Patent Laid-open No. 2006-321880; Patent Literature 11, Japanese Patent Laid-open No. 2006-321929; Patent Literature 12, Japanese Patent Laid-open No. 2005-325225; and Patent Literature 13, Japanese Patent Laid-open No. 6-080619).

One method to prevent scattering into air of formaldehyde and acetaldehyde contained in a high-molecular compound or generating from a high-molecular compound by means of breakdown is to add an additive beforehand to all areas of the high-molecular compound including the interior as well as corners and edges. However, this method can be applied only to moldings obtained from high-molecular compounds, and does not provide a method do deal with formaldehyde and acetaldehyde breaking free from natural leathers in which treatment agents have accumulated in the course of treatment of natural hide or from the internal structure of the leather or these treatment agents in the leather.

(3) If the presence of formaldehyde, etc., in air is undesirable, a substance capable of adsorbing formaldehyde can be fixed beforehand so that formaldehyde is adsorbed by this adsorbent substance and thus becomes no longer present in air. Examples of this method include the following:

(i) Coat a hydrazide compound onto silica gel or alumina grains to purify air (Patent Literature 14, Japanese Patent Laid-open No. 2007-167495).

(ii) Efficiently remove odorous components dispersed in the room such as formaldehyde and acetaldehyde, and eliminate the odors of at least formaldehyde and other aldehydes in the room, by providing the carpet or fiber material with an adsorbent that adsorbs aldehydes (=fixing adipic acid dihydrazide in gel form) (Patent Literature 15, Japanese Patent Laid-open No. Hei 11-46965).

(iii) Provide an anti-slip part made of foam rubber on the surface of at least one side of the seat, wherein an adipic acid dihydrazide compound is present in such anti-slip part as an adsorbent that adsorbs aldehydes (Patent Literature 16, Japanese Patent No. 3053373 Specification).

(iv) Provide an adhesive layer on the back surface of the base material containing, impregnated with, or coated with, a formaldehyde trapping agent (Patent Literature 17, Japanese Patent Laid-open No. Hei 10-102782). This method applies only to formaldehyde.

(v) Provide a deodorizing fiber effective on aldehydes and phenols by fixing onto the fiber surface a hydrazide compound containing at least two hydrazine groups in the molecule and forming a cross-link with a multifunctional monomer, and then by attaching 0.1 to 10 percent by weight of this hydrazide compound, such as adipic acid dihydrazide compound, relative to the fiber (Patent Literature 18, Japanese Patent Laid-open No. Hei 9-78452).

This method aims to adsorb and remove formaldehyde suspended in air and does not provide or indicate any method aimed at confining formaldehyde and acetaldehyde within a product where they generate.

(vi) With respect to formaldehyde confined in leather, a method to remove formaldehyde after it has eluted into water was examined, wherein specifically treating such formaldehyde using sodium hydrogen sulfite, urea and ammonium water was examined. Also, hide powder was treated with a chromium tanning agent, after which the treated hide powder was fed through an aldehyde chromium exhaustion promotion process and then washed with water to measure the change in formaldehyde concentration. In addition, pig skin tanned with formaldehyde (FA leather) was treated with a sodium hydrogen sulfite solution and ammonium water to measure the amount of formaldehyde that eluted. Furthermore, chamois skin was treated with a sodium hydrogen sulfite solution, bisulfite ammonium solution, urea solution and ammonium water to calculate the removal ratio of formaldehyde. Finally, natural leather was treated with a chromium tanning agent, anionic resin tanning agent and cationic resin tanning agent to measure the amount of formaldehyde that eluted (Hikaku Kagaku (Leather Chemistry) Vol. 34, No. 4, p. 177). The foregoing is aimed at removing eluted formaldehyde using an aqueous sodium hydrogen sulfite solution, etc., and does not mention prevention of formaldehyde generation by means of trapping and thereby fixing formaldehyde within the leather.

Instead of trapping the target formaldehyde which is present in the applicable substance, the aim is to abandon trapping this formaldehyde within the substance, but to actively remove it to the outside using an aqueous solution and then trap the removed formaldehyde. What is described here is a treatment used in analytical chemistry, etc., and it does not provide a method to defend against generation of formaldehyde.

Treatments using urea, sodium disulfide, etc., are also described, but fixing of formaldehyde in the leather in these applications is not mentioned.

(vii) The applicants of the present patent earlier found a countermeasure to prevent the aforementioned fogging by revealing that this fogging is caused by lipid derived from cowhide and lipid derived from a chemical agent (greasing agent) used in the manufacturing process, where some of these lipids volatilize at high temperatures and then attach to the glass surface where they cool and condense again to eventually cause fogging of the glass. To be specific, the applicants developed an invention to "prevent heat shrinkage while reducing volatile substances to inhibit fogging, and also inhibit generation of foul smell due to oxidization, even in areas subject to a severe use environment, by (1) using a softening agent to avoid use of any greasing agent that causes fogging and foul smell, (2) using a vegetable tannin to avoid use of any synthetic tannin that causes fogging and foul smell, (3) using an anti-oxidant to inhibit generation of volatile substances and foul smell due to acid decomposition of lipids, etc., (4) inducing shrinking beforehand by means of heat treatment, and (5) applying resin on the back surface to cut off release of volatile substances (Patent Literature 19, Japanese Patent Laid-open No. 2007-070487). However, fogging is caused by volatile substances at high temperatures and is different from the problems caused by formaldehyde and acetaldehyde generating from natural leathers not at high temperatures, and thus the aforementioned invention does not intend to inhibit/prevent generation of formaldehyde and acetaldehyde from natural leathers.

Patent Literature 1: Published Japanese Translation of PCT International Patent Application No. Hei 6-502886

Patent Literature 2: Japanese Patent Laid-open No. 2005-272725

Patent Literature 3: Japanese Patent Laid-open No. 2006-8723

Patent Literature 4: Japanese Patent Laid-open No. 2000-119700

Patent Literature 5: Japanese Patent Laid-open No. 2005-272725

Patent Literature 6: Japanese Patent Laid-open No. 2007-84527

Patent Literature 7: Japanese Patent Laid-open No. 2003-277411

Patent Literature 8: Japanese Patent Laid-open No. 2006-182825

Patent Literature 9: Japanese Patent Laid-open No. 2006-188669

Patent Literature 10: Japanese Patent Laid-open No. 2006-321880

Patent Literature 11: Japanese Patent Laid-open No. 2006-321929

Patent Literature 12: Japanese Patent Laid-open No. 2005-325225

Patent Literature 13: Japanese Patent Laid-open No. 6-080619

Patent Literature 14: Japanese Patent Laid-open No. 2007-167495

Patent Literature 15: Japanese Patent Laid-open No. Hei 11-46965

Patent Literature 16: Japanese Patent No. 3053373

Patent Literature 17: Japanese Patent Laid-open No. Hei 10-102782

Patent Literature 18: Japanese Patent Laid-open No. Hei 9-78452

Patent Literature 19: Japanese Patent Laid-open No. 2007-070487

Non-patent Literature 1: Ten-nen Hikaku Kagaku (Natural Leather Chemistry) Vol. 34, No. 4, p. 177

SUMMARY OF THE INVENTION

Problems to be Solved by the Invention

The object of the present invention is to provide, in relating to a natural leather obtained by tanning, re-tanning, dyeing and greasing steps, or natural leather obtained by forming a coating film on it after the aforementioned processes: a natural leather that inhibits or prevents separation and release from the natural leather of formaldehyde and acetaldehyde that break free as a result of breakdown of the internal structure of the natural leather or any substance taken into the structure; as well as a natural leather treatment agent capable of inhibiting or preventing release from the leather of formaldehyde and acetaldehyde that break free from a tanning agent, greasing agent or other chemical agent added and taken into the leather in the greasing step, etc., of the natural leather manufacturing process designed for manufacturing such natural leather.

Means for Solving the Problems

The inventors of the present invention tackled the aforementioned object and found the need to examine the following points:

A (1) A re-tanning step where a synthetic tanning agent, etc., is used, a dyeing step where a dye is used, and a greasing step where a greasing agent is used, all performed after the tanning step, are implemented successively in the same drum.

In each of the aforementioned steps, chemical reaction occurs between the natural leather to be treated and the treatment agent such as tanning agent, dye or greasing agent, wherein a problem may occur when the tanning agent or greasing agent contacts the natural leather to cause some part of the agent to be broken down and generate formaldehyde and acetaldehyde in the treatment process, which is then released and accumulates during the treatment process or in the leather and consequently released from the natural leather and detected.

One possible countermeasure to generation of formaldehyde and acetaldehyde during the chemical reaction treatment is to reduce the amounts of formaldehyde and acetaldehyde generated in the treatment process from the aforementioned chemical reaction, and keep the generated amounts to within a specified range and thereby reduce the generated amounts. In light of the above, the inventors examined whether the generation of formaldehyde and acetaldehyde, which is the target of the present invention, was caused by a problem occurring when a treatment agent contacts the natural leather in the treatment process, which causes a part of the treatment agent to be broken down.

(2) It is also possible that a treatment agent that was taken into the natural leather and bound with the natural leather breaks down partially due to some action or cause and thereby releases formaldehyde and acetaldehyde, which is then generated from the natural leather.

In this case, the treatment agent can be introduced to the natural leather manufacturing process together with a fixing agent or trapping agent that takes in and fixes formaldehyde and acetaldehyde generating in the natural leather as a result of breakdown, in order to take in formaldehyde and acetaldehyde breaking free as a result of breakdown of the treatment agent added in the natural leather manufacturing process and trap them in the natural leather, thereby preventing generation of formaldehyde and acetaldehyde from the natural leather.

In connection with processes for treating natural leather using chemical agents, an idea to introduce to the natural leather a treatment agent simultaneously with a fixing agent or trapping agent of formaldehyde and acetaldehyde so that they are taken into the natural leather at the same time and consequently if the treatment agent breaks down, the fixing agent or trapping agent traps the breakdown product in the natural leather, is not known in the field of natural leather manufacturing processes or even in the field of general manufacturing processes.

B The inventors checked (1) and (2) in A above through experiment and confirmed that (2) was more effective, and consequently completed the present invention. The specifics are as follows.

(1) To confirm the presence of formaldehyde and acetaldehyde in each of the re-tanning step where a synthetic tanning agent is used, dyeing the step where a dye is used and the greasing step where a greasing agent is used, whether or not the air and liquid in an actually operating drum system contained formaldehyde and acetaldehyde was checked, but the presence of neither could be confirmed.

In other words, the hypothesis of a problem occurring when a treatment agent such as tanning agent, dye or greasing agent contacts the hide or leather partially breaks down, and consequently formaldehyde and acetaldehyde generate and are released in the treatment process and accumulate during the treatment process or in the leather, thereby leading to generation of formaldehyde and acetaldehyde, was denied.

Accordingly, the cause of generation of formaldehyde and acetaldehyde—after the tanning agent and greasing agent taken into the natural leather are bound with the natural leather, an occurrence of partial breakdown for some reason that causes formaldehyde and acetaldehyde to be released and generated from the natural leather—was considered.

The fact that formaldehyde and acetaldehyde is generating from natural leather inevitably leads to this interpretation.

In conclusion, a treatment agent taken into the natural leather binds with the natural leather, and then the treatment agent partially breaks down for some reason to cause formaldehyde and acetaldehyde to break down and release and generate from the natural leather.

(2) Next, natural leather was treated with a group of treatment agents including tanning agent, re-tanning agent and dye, and in the subsequent greasing step it was treated with a natural leather treatment agent containing a greasing agent for natural leather (specifically by treating the natural leather with the greasing agent to have the agent seep into the natural leather) as well as a trapping agent or fixing agent that entraps in the natural leather the formaldehyde and acetaldehyde generating in the natural leather.

For this trapping agent or fixing agent, a hydrazide compound, or a sodium hydrogen sulfite and hydrazide compound, was/were used. As a result, generation of formaldehyde and acetaldehyde was inhibited, while generation of formaldehyde and acetaldehyde was not inhibited with the natural leather that was greased using a greasing agent to which this trapping agent or fixing agent was not added.

Based on the above, it was confirmed that formaldehyde and acetaldehyde breaking free within the natural leather as a result of breakdown could be contained in the natural leather by using a natural leather treatment agent that contains a trapping agent or fixing agent designed to trap formaldehyde and acetaldehyde breaking free from the natural leather and contain them in the natural leather.

The greasing agent was used in the presence of the fixing agent or trapping agent in the greasing step, for the reason explained below.

Greasing natural leather in the presence of a treatment agent that contains a greasing agent and a trapping agent or fixing agent designed to trap formaldehyde and acetaldehyde and confine them in the natural leather, allow for confinement in the natural leather of formaldehyde and acetaldehyde breaking free as a result of breakdown in the natural leather of the greasing agent for use in the greasing step along with the treatment agents used before the greasing step, and no treatment agent is taken into the natural leather after the greasing step.

After the greasing step the natural leather goes through the drying step, is coated with a back filling agent, and then a coating film is formed on the natural leather using polyurethane or other resin. It is not possible that formaldehyde and acetaldehyde generate as a result of formation of a coating film using polyurethane.

(3) As explained above, a natural leather obtained by being greased using a greasing agent in the presence of a hydrazide compound, or a sodium hydrogen sulfite and hydrazide compound, as a trapping agent or fixing agent to trap formaldehyde and acetaldehyde and confine them in the natural leather, in the greasing step as part of the manufacturing process comprising a series of steps including re-tanning, dyeing and greasing, allows for inhibition and prevention of formaldehyde/acetaldehyde generation by trapping formaldehyde and acetaldehyde in the natural leather as a result of the action of the hydrazide compound or a sodium hydrogen sulfite and hydrazide compound. The aforementioned operation involves treatment, in the greasing step, using a greasing agent in the presence of a hydrazide compound, or a sodium hydrogen sulfite and hydrazide compound. In this case, the same result can be achieved by adding the sodium hydrogen sulfite, hydrazide compound, or sodium hydrogen sulfite and hydrazide compound, after adding the greasing agent, separately from the greasing agent. The same result can also be achieved by adding the greasing agent, washing the natural leather with water to remove the attached greasing agent, and then adding the hydrazide compound or a sodium hydrogen sulfite and hydrazide compound.

(4) A natural leather obtained by forming a coating film over the entire surface of a leather obtained as above, or automobile interior part using such natural leather, can inhibit generation of formaldehyde and acetaldehyde.

Effects of the Invention

According to the present invention, which relates to a natural leather completing the greasing step and drying step after tanning, re-tanning and dyeing, or natural leather obtained by forming a coating film on it after the drying step, a natural leather can be obtained that inhibits or prevents formaldehyde and acetaldehyde from breaking free inside and coming out of the natural leather as a result of breakdown of the internal structure of the natural leather or any treatment agent taken into the natural leather. A natural leather treatment agent can be obtained which is added in the greasing step of the natural leather manufacturing process for manufacturing such natural leather, wherein the natural leather treatment agent greases the natural leather and at the same time inhibits or prevents formaldehyde and acetaldehyde from breaking free inside and coming out of the natural leather so that formaldehyde and acetaldehyde generated in the natural leather can be confined in the natural leather.

BRIEF DESCRIPTIONS OF THE DRAWINGS

FIG. 1 shows a process comprising mainly a tanning step.

FIG. 2 shows a process comprising mainly synthetic tannin, dyeing, greasing and drying steps.

FIG. 3 shows a process comprising mainly a coating step.

BEST MODE FOR CARRYING OUT THE INVENTION

In relation to a natural leather treated with a treatment agent in the greasing step following the series of steps in the manufacturing process for natural leather including pre-treatment for tanning, tanning, re-tanning and dyeing, and also in relation to a natural leather obtained by forming a coating film on it after the subsequent drying step, formaldehyde and acetaldehyde are observed to break free and come out of the natural leather as a result of breakdown of the internal structure of the natural leather or any treatment agent taken into the natural leather. Generation of formaldehyde and acetaldehyde is not desirable as it presents health risks to users of natural leathers.

The present invention provides a natural leather obtained by being treated in a series of steps including pre-treatment for tanning the natural leather, tanning, re-tanning and dyeing, using treatment agents including tanning agent, re-tanning agent and dye, and then treated in the subsequent greasing step using a natural leather treatment agent containing a greasing agent as well as a trapping agent or fixing agent for confining in the natural leather the formaldehyde and acetaldehyde generated in the natural leather.

The trapping agent or fixing agent for confining in the natural leather the formaldehyde and acetaldehyde generated in the natural leather acts to inhibit or prevent formaldehyde and acetaldehyde from breaking free and coming out of the natural leather as a result of breakdown of any substance taken into the natural leather, thereby confining in the natural leather the formaldehyde and acetaldehyde generating in the natural leather.

Also, the present invention provides a natural leather treatment agent containing a greasing agent for use in the greasing step for obtaining natural leather, as well as a trapping agent or fixing agent for confining in the natural leather the formaldehyde and acetaldehyde generating in the natural leather.

The present invention relates to a series of treatment steps for natural leather implemented by using treatment agents, and is characterized by the greasing step which is the final stage of these treatment steps.

The series of treatment steps for manufacturing natural leather are explained below, and the aforementioned unique characteristics are explained in detail in the explanation of the greasing step.

The series of treatment steps for manufacturing natural leather are explained.

The series of treatment steps for manufacturing natural leather are divided into a process comprising mainly pre-treatment for tanning and tanning steps (FIG. 1), process comprising mainly re-tanning, dyeing, greasing and drying steps (FIG. 2), and process comprising mainly back filler application/coating steps (FIG. 3).

The pre-treatment for tanning and tanning steps are included in the process from water washing and soaking of material hide to trimming (FIG. 1).

In the water washing/soaking step for material hide, the material hide that has been stored at low temperature to maintain freshness and prevent decay is transferred into the lime drum, where water is added to the salt-cured material hide to bring it back to the state of raw hide, and then salt and impurities are removed and pH is adjusted for liming.

In the fleshing/trimming step, the material hide is transferred onto the fleshing machine and trimming machine, where excess fat and other gluey substances are mechanically removed, along with salt and impurities, and then the edges are trimmed. In the liming step, the material hide is transferred into the lime drum, where hairs on the surface of hide are dissolved and scudding is implemented, after which lime is permeated into the hide to loosen the fibers.

In the raw band splitting step, the material hide is transferred onto the band machine, where the hide is strained to a thickness appropriate for the specific purpose and also split into the surface layer and base.

The deliming, enzymatic hydrolysis and pickling steps are as follows.

Limes from the aforementioned liming step are removed, enzymatic hydrolysis is implemented using an enzyme, and the material hide is pickled.

In the tanning step, a tanning agent is supplied as a treatment agent and the obtained hide is tanned with the tanning agent to manufacture a leather.

In the squeezing step, the leather is transferred into the water draining machine to squeeze the leather. Next, squeezed leathers are sorted and graded according to their surface conditions such as presence of flaws or holes, area, etc.

In the shaving step, the leather is transferred onto the shaving machine to shave it to a thickness appropriate for the specific purpose. In the trimming step, unnecessary waste parts, etc., are cut on the trimming table to prevent breakage and thereby increase work efficiency in the subsequent steps.

The aforementioned tanning step is where the hide is treated in the presence of a tanning agent and water under an acid condition. The tanning agent induces cross-linking in the collagen substance in the hide and gives resistance to heat, microorganisms and chemical substances, as well as flexibility, to the hide.

For the tanning agent, a trivalent chromium complex such as a chromium compound using a hexaaqua crystal sulfate expressed by $Cr_2(SO_4)_3$ or an aldehyde compound including glutaraldehyde is used. These substances are traditionally known as tanning agents and any appropriate product available on the market can be purchased and used.

Examples of chromium complex products include the following:

ChromitanB, ChromitanMS, ChromitanFM, BaychromaCH, BaychromaCL, BlancorolRN, BlancorolRC, etc.

In the tanning step, chromium salt containing 2 to 2.5% of $Cr_2O_3$ relative to the untreated hide is introduced, but reportedly only 70 to 80% of it is fixed in the hide and 20 to 30% is released into the spillage.

In addition to chromium, glutaraldehyde can also be used as a tanning agent. This glutaraldehyde is explained below. Glutaraldehyde is a known substance and if a glutaraldehyde product available on the market is to be used, Relugan GT-50, Relugan GTW, Ucar Tanning Agent GA-25, Ucar Tanning Agent GA-50, etc., can be used.

The use quantity of glutaraldehyde is approx. 1 to 10 percent by weight relative to the weight of leather (Japanese Patent Laid-open No. Hei 08-232000).

All of these tanning agents chemically bind with the components of natural leather.

In addition to the above, synthetic tanning agents (synthetic tanning agents are explained in connection with the re-tanning step) and vegetable tannins (MimosaME, MimosaFE, Quebracho, etc.) can be used. These substances are traditionally known as tanning agents and any appropriate product available on the market can be purchased and used.

The re-tanning step, dyeing step and greasing step are performed in the same drum (FIG. 2).

When each step ends, thorough water wash is performed to prevent the result of the preceding step from affecting the next step.

In the re-tanning step, a synthetic tanning agent, vegetable tanning agent, etc., is used as a re-tanning agent. In some cases, the aforementioned tanning agents such as chromium, glutaraldehyde, etc., may be added.

Neutralization is confirmed before re-tanning. To be specific, a pH indicator is dripped onto a cross-section of the natural leather and how the color change is observed. As a rough guide, the surface layer should have a pH value of around 5 or 6, and inner layer 3 to 4, for the upper leather type.

(1) As for synthetic tanning agents, the following tanning agents are used:

Formaldehyde condensation product of aromatic sulfonic acid (mainly naphthalene or phenol sulfonic acid) and formaldehyde condensation product of amino compound, the details of which are explained below:

(i) Known examples of the formaldehyde condensation product of phenol sulfonic acid are as follows:

(a) Condense a mixture of phenol sulfonic acid and bishydroxyphenylsulfone at a mol ratio of 1:3, with 2 mol of formaldehyde, in an aqueous solution of pH 6 to 9 at 100 to 120° C., and then the obtained condensation product is adjusted to a pH of 3.5 using sulfuric acid and acid number (AN) of 120 using phthalic acid, and then dried.

(b) Mix sodium salt of phenol sulfonic acid (65% solution) with bishydroxyphenylsulfone (55% suspension) at a mol ratio of 2.5:1. Add 2.5 equivalent of formaldehyde (30% solution) to the mixture at high temperature and cause condensation for 3 hours at 112 to 115° C. The obtained rough condensation product is adjusted to an AN of 100 using adipic acid, and then dried.

When the molecular weight distribution of the formaldehyde condensation product of phenol sulfonic acid was measured by gel chromatography developed with an organic solvent, molecular weights were distributed in a range of Mw400 to 4000 and the center was around Mw3000.

Any of the following commercial products can be purchased and used.

For the formaldehyde polycondensation product of phenol sulfonic acid, Basyntan DLX-N, MLB, SL, SW Liquid, Tamol NNOL (manufactured by BASF), Tanigan WLF (manufactured by LANXESS), etc., can be used.

(ii) Formaldehyde condensation product of naphthalene sulfonic acid (a) Sulfonate $1.4H_2SO_4$ equivalent of naphthalene for 2 hours at 145° C. Take 1,000 g of the obtained naphthalene sulfonic acid mixture and add 800 g of bishydroxyphenylsulfone and 250 ml of 37% formaldehyde solution, and cause condensation for 3 hours at 100 to 120° C. The obtained product is adjusted to a pH of 3.5 and AN of 80 using sodium hydroxide solution and phthalic acid, and then spray dried.

Another manufacturing method is as follows.

(b) Sulfonate $1.4H_2SO_4$ mol of naphthalene for 3 hours at 145° C., and then cause it to condense with 0.66 mol of formaldehyde for 3 hours, after which the obtained product is cooled and adjusted to a pH of 3.5, and AN of 50 using sodium hydroxide solution and glutaric acid, and then spray dried.

When the molecular weight distribution of each of these products was measured by gel chromatography developed with an organic solvent, molecular weights were distributed in a range of Mw200 to 2000 and the center was around Mw1300.

Any of the following commercial products can be purchased and used.

For the formaldehyde polycondensation product of naphthalene sulfonic acid, Basyntan FC, Tamol NA (manufactured by BASF), Ukatan GM (manufactured by Schill+Seilacher), Tanigan BN (manufactured by LANXESS), Irgatan LV (manufactured by TLF), and BELLCOTAN A, PT, PS (manufactured by Nippon Fine Chemical) can be used.

(iii) Condensation product of phenolsulfonic acid, urea and formaldehyde

Treat 1 mol of phenol, 0.5 mol of sulfuric acid, 1 mol of urea and 0.9 mol of formaldehyde by reacting them under strong acidity at 100 to 110° C., and the obtained condensation product is buffered with 0.2 mol of sodium hydroxide solution. The obtained intermediate product is further condensed with 0.8 mol of phenol and 1.2 mol of formaldehyde, after which the obtained product is cooled and adjusted to a pH of 3.5 and AN of 80 using sodium hydroxide solution, formic acid and phthalic acid, and then spray dried.

If a commercial product is to be used, Basyntan (registered trademark) DLX can be purchased and used.

(2) Using a resin tanning agent

The main component is a condensation product of urea, dicyandiamide, melamine or other amino compound with formaldehyde.

For mixtures of melamine formaldehyde condensation product and urea formaldehyde condensation product, Relugan D, DLF or S (manufactured by BASF), etc., can be used.

For polyacrylic acid resin tanning agents, ReluganSE, RE, RV (manufactured by BASF), LubritanGX (Rohm and Haas), etc., can be purchased and used.

Preferably a synthetic tanning agent or other tanning agent used in the re-tanning step should be an aqueous solution containing 50 to 200 percent by weight relative to the weight of the leather used.

The treatment condition for such tanning agent should be pH 3.0 to 8.0, or more preferably 3.5 to 6.5. The re-tanning time should be preferably 1.5 to 24 hours, or more preferably 2 to 8 hours.

In the dyeing step, the leather is dyed using a dye.

In the dyeing step, a dye corresponding to the desired color is used.

Although dyes should not generate formaldehyde and acetaldehyde at normal room temperatures, the following explanation is given regarding dyes.

The leather obtained through the aforementioned treatment method is dyed using an anionic water-based dye. Here, this anionic water-based dye is constituted by a water-based medium, dye, etc. A water-based medium may be water or mixture of water and alcohol or other water-soluble medium. Also note that although any dye can be used that can be used to add color to the leather, representative examples include acid dyes and reactive dyes.

Acid dyes include C. I. Acid Black 1, C. I. Acid Black 26, C. I. Acid Black 52, C. I. Acid Green 9, C. I. Acid Green 25, C. I. Acid Brown 2, C. I. Acid Brown 13, C. I. Acid Violet 43, C. I. Acid Violet 49, C. I. Acid Orange 7, C. I. Acid Orange 56, C. I. Acid Orange 67, C. I. Acid Blue 40, C. I. Acid Blue 45, C. I. Acid Blue 74, C. I. Acid Blue 92, C. I. Acid Blue 113, C. I. Acid Blue 127, C. I. Acid Blue 185, C. I. Acid Red 18, C. I. Acid Red 27, C. I. Acid Red 52, C. I. Acid Red 82, C. I. Acid Red 87, C. I. Acid Red 114, C. I. Acid Red 186, C. I. Acid Red 266, C. I. Acid Yellow 1, C. I. Acid Yellow 7, C. I. Acid Yellow 23, C. I. Acid Yellow 110, etc.

Reactive dyes include C. I. Acid Black 5, C. I. Acid Brown 1, C. I. Acid Violet 2, C. I. Acid Orange 1, C. I. Acid Orange 2, C. I. Acid Blue 4, C. I. Acid Blue 19, C. I. Acid Red 6, C. I. Acid Red 17, C. I. Acid Yellow 3, C. I. Acid Yellow 17, etc. The aforementioned dyes can be combined. Also, a dye or dyes is/are dissolved and/or dispersed in a water-based medium before application to adjust to a desired color. It is also possible to add pigments or other coloring materials to the extent that it does not inhibit the coloring effect.

As for the dyeing method, the following explains dying the surface of an upper leather made of chromium-tanned cowhide of approx. 1.4 mm in thickness.

After the re-tanning, the shaved leather (completing the shaving step and trimming step) is washed with 400% of water based on the wet weight of the shaved leather being 100% (the wet weight of the shaving leather is hereinafter used as the reference), and the leather is dyed in an aqueous solution constituted by 250% of water (50° C.), 0.5% of level dyeing agent and 2.5% of surface dye (1:20). One half of the step is implemented by 20 minutes of rotation, and the remaining half by 30 minutes of rotation. The fixing operation using 1% of formic acid (1:10) comprises the two-thirds of the step implemented by 10 minutes of rotation, and the remaining one-third by 10 minutes of operation.

The greasing step is performed after the dyeing step following re-tanning, and designed to add the required flexibility to the leather product by treating the leather with an oil agent called "greasing agent." Not a few greasing agents have surface activation property. As a result, these agents permeate into the natural leather easily.

The dyed leather introduced to the greasing step is wet with water, and flexibility of fibers is retained by the water present between the fibers constituting fiber bundles. If this water dries up, fibers will stick together and both the fibers and structure will harden. Accordingly, it is effective to apply an oil agent to the space between fibers, before the water dries, to inhibit sticking of fibers. Also, functions to protect leather fibers (water repellency, water-proofness), touch and bulge are added. This is the purpose of the greasing step, where a greasing agent is used.

As for the conditions of the greasing step, the dyed leather is treated in the same drum at a temperature condition of 50 to 60° C. using a natural leather treatment agent containing a greasing agent as well as a treatment agent for confining in the natural leather the formaldehyde and acetaldehyde generating in the natural leather.

The natural leather treatment agent conforming to the present invention, which is introduced in the greasing step, is a composition constituted by the components specified below.

Based on the wet weight of shaved leather being 100%, 1 to 8 percent by weight of greasing agent, 0.5 to 3 percent by weight (when hydrazide compound is contained) or 0.6 to 6.0 percent by weight (when both sodium hydrogen sulfite and hydrazide compound are contained) of treatment agent that confines in the natural leather the formaldehyde and acetaldehyde generating in the natural leather, and 50 to 200 percent of water are contained.

The greasing agent has the effect of permeating into the leather and thereby preventing the fibers constituting the leather from sticking together when the water dries, while also adding flexibility to the leather by improving the sliding of fibers against each other after drying. The greasing agent is a composition constituted by such components and water.

The treatment agent that confines in the natural leather the formaldehyde and acetaldehyde generating in the natural leather is taken into the natural leather together with the greasing agent and inhibits or prevents formaldehyde and acetaldehyde from breaking free and coming out of the natural leather as a result of breakdown of any substance taken into the natural leather, thereby effectively confining in the natural leather and preventing the leakage therefrom of the formaldehyde and acetaldehyde generating in the natural leather. Water dissolves the greasing agent and treatment agent that confines in the natural leather the formaldehyde and acetaldehyde generating in the natural leather, and becomes a medium that can easily permeate into the natural leather.

The specific substance used is a hydrazide compound, or a sodium hydrogen sulfite and hydrazide compound. If a hydrazide compound is used, its content must not exceed 3 percent by weight because then precipitation will occur and greasing will be negatively affected. Normally a hydrazide compound content of approx. 2 percent by weight results in small contents of formaldehyde and acetaldehyde.

Under the present invention, a natural leather is treated by introducing into the drum used in the greasing step a natural leather treatment agent containing a greasing agent for natural leather as well as a treatment agent for confining in the natural leather the formaldehyde and acetaldehyde generating in the natural leather.

This natural leather treatment agent is explained below.

(1) The natural leather treatment agent contains a greasing agent as well as a treatment agent that confines in the natural leather the formaldehyde and acetaldehyde generating in the natural leather.

(i) If the treatment agent that confines in the natural leather the formaldehyde and acetaldehyde generating in the natural leather in (1) above is a hydrazide compound:

(a) The hydrazide compound in (i) above is an adipic acid dihydrazide:

(ii) If the treatment agent that confines in the natural leather the formaldehyde and acetaldehyde generating in the natural leather in (1) above is a sodium hydrogen sulfite and hydrazide compound:

(a) The hydrazide compound in (ii) above is an adipic acid dihydrazide.

The greasing agent and the treatment agent that confines in the natural leather the formaldehyde and acetaldehyde generating in the natural leather may be pre-mixed and introduced into the drum in the greasing step, or the greasing agent may be introduced separately from the treatment agent that confines in the natural leather the formaldehyde and acetaldehyde generating in the natural leather.

Greasing agents include the following, and any one of these may be selected and used.

(1) Anionic greasing agents are as follows.

(i) Sulfated oil

Sulfated oil is a natural unsaturated oil that is mixed with sulfuric acid and turned into sulfuric ester. The hydroxyl groups and double bonds are partially sulfated.

Examples include the following:

Sulfated aliphatic acid ester: Lipoderm Liquor PU (manufactured by BASF)

Synthetic sulfonated lipid: SYNCUROL KV (manufactured by MUNZING) Mixture of sulfonated ester and hydrocarbon: SYNCUROL 79 (manufactured by MUNZING)

Sulfonated ester: SYNCUROL SE (manufactured by MUNZING)

Synthetic sulfonated ester: SYNCUROL PF, MAX (manufactured by MUNZING)

(ii) Sulfonated oil

Sulfonated oil is a synthetic oil or natural oil containing unsaturated groups, which is treated with sulfuric anhydride, fuming sulfuric acid, chlorosulfonic acid, etc., to neutralize the double bonds in the molecule by means of sulfonation.

Examples of sulfonated oil include SK Oil HF (manufactured by Sunplus) and Pellastol ES (manufactured by Zschimmer & Schwarz Chemische Fabriken), among others.

Note that SK Oil HF is a synthetic sulfonated oil with anti-yellowing property and constituted by a mixture of 50 percent by weight of unreacted raw oil, 25 percent by weight of sulfuric ester and 25 percent by weight of hydrolysis product.

Other examples include Taakon FA-200 (manufactured by Taiko Oil Chemicals), Pelgrassol SF (manufactured by Zschimmer & Schwarz Chemische Fabriken), and the like. Taakon FA-200 is a mixture of, among others, fatty acid monoglyceride, natural sulfonated oil and oxidized products thereof.

(iii) Sulfited oil

Sulfited oil is a sulfonate obtained from a highly unsaturated natural oil or synthetic oil, which is treated with sulfite as a sulfonating agent.

Mixture of sulfited fish oil, natural oil and emulsifier: Lipsol EB (manufactured by MUNZING)

Sulfited fish oil: OPTIMALIN UPNC (manufactured by MUNZING)

Water-soluble emulsion of vegetable oil and sulfited animal oil: Lipoderm Liquor A1 (manufactured by BASF)

(iv) Fatty acid soap

Fatty acid soap is a soap obtained by saponifying a natural oil using an aqueous alkali solution. Ammonium salt and potassium salt are also used as greasing agents. Since fatty acid breaks free at neutral to acidity, these greasing agents have the effects of surface active agent and neutral oil.

Denatured fatty acid: Lipoderm Liquor LA (manufactured by BASF)

(v) Phosphorylated oil

Egg yolk, soybean lecithin and other phospholipids have been used. Recently, phosphate ester salts of higher alcohol and polyoxyethylenealkylether are widely used forms of phosphorylated oil.

Emulsion of synthetic oil and lecithin oil mixture: Lipsol LQ (manufactured by Schill+Seilacher)

Phosphate ester oil: Lipoderm Liquor PU (manufactured by BASF)

Blend of sulfated vegetable oil, phosphate ester salt of fatty alcohol and hydrocarbon: LIQUOR KIM (Nagi Shokai)

(vi) Multipolar greasing agents are mixtures of anionic agents, nonionic greasing agents and a small amount of cationic greasing agents.

(vii) Other anionic greasing agents

Examples include mono- or di-alkyl succinic acid, alkylmalonic acid, carboxylic acid salt with the alkyl chain at both ends and other substances having complex activation groups, and polyacrylic acid derivatives having long-chain alkyl groups.

The aforementioned greasing agents are combined with the surface active agents specified below.

(2) Cationic greasing agents

For cationic greasing agents, quaternary ammonium salt, aliphatic amine, aliphatic polyamine condensation product are used.

(3) Amphoteric greasing agents

For amphoteric greasing agents, lecithin has long been used as a greasing agent having both anionicity and cationicity in the same molecule.

(4) Nonionic greasing agents

Nonionic greasing agents are never used alone, but always combined with anionic or cationic greasing agents.

Aqueous solution of natural oil and nonionic surface active agent: Lipoderm Liquor IC (manufactured by BASF)

Aqueous solution mixture of wax, natural oil and surface active agent: Lipoderm Liquor SC (manufactured by BASF)

Aqueous solution of nonionic surface active agent, sulfited oil and sodium salt: Lipoderm Liquor WF (manufactured by BASF)

Mixture of natural oil, synthetic oil and synthetic emulsifier: Lipsol MSG (manufactured by Schill+Seilacher)

Neutral oils, specifically (i) animal oil, (ii) marine animal oil, (iii) vegetable oil, (iv) mineral oil, and (v) synthetic oil The calculations of greasing agents actually used are explained below.

The (measured) amount of greasing agent considered to be actually remaining in the natural leather is the amount of greasing agent used, less the (measured) amount of greasing agent contained in the residual liquid left in the greasing step and (measured) amount of greasing agent washed away when the natural leather is washed with water.

The amount of greasing agent initially used was 1 to 8 (parts by weight; same applies hereinafter unless otherwise specified) based on the dry weight of shaved leather being 100 parts. The amount of greasing agent contained in the residual liquid remaining in the greasing step was 0.2 to 1.6, and the amount of greasing agent washed away when the natural leather was washed with water was 0.1 to 0.8. Accordingly, the amount of greasing agent considered to be actually remaining in the natural leather is 0.7 to 5.6.

Also note that the (measured) amount of treatment agent considered to be actually remaining in the natural leather, where such treatment agent is one that confines in the natural leather the formaldehyde and acetaldehyde generating in the natural leather, is the (measured) amount of treatment agent actually introduced, less the (measured) amount of treatment agent added in the natural leather greasing step and now contained in the residual liquid remaining in the greasing step and (measured) amount of treatment agent washed away when the natural leather is washed with water.

The (measured) amount of treatment agent initially added and considered to be actually remaining in the natural leather was 0.5 to 3, the (measured) amount of treatment agent contained in the residual liquid was 0.1 to 0.6, and the (measured) amount of treatment agent considered to have been washed away when the natural leather was washed with water was 0.05 to 0.3. Accordingly, the amount of treatment agent considered to be actually remaining in the natural leather is 0.35 to 2.1.

After the greasing step, the natural leather is washed thoroughly with water as deemed appropriate and the cleaned leather is then heated to a range of 60 to 80° C. This way, residual sodium hydrogen sulfite and hydrazide compound can be removed.

The aforementioned hydrazide compound is not specifically limited, and examples include monohydrazide compounds having one hydrazide group in the molecule, dihydrazide compounds having two hydrazide groups in the molecule, and polyhydrazide compounds having three or more hydrazide groups in the molecule, among others.

Specific examples of monohydrazide compounds include those expressed by General Formula (1) below:

[Chemical Formula 1]

$$R—CO—NHNH_2 \quad (1)$$

(In the formula, R represents a hydrogen atom, alkyl group or aryl group that can have a substitutional group.)

In General Formula (1) above, an alkyl group represented by R may be, for example, a methyl group, ethyl group, n-propyl group, n-butyl group, n-pentyl group, n-hexyl group, n-heptyl group, n-octyl group, n-nonyl group, n-decyl group, n-undecyl group or other straight-chain alkyl group with 1 to 12 carbons. If it is an aryl group, examples include a phenyl group, biphenyl group and naphthyl group, among others. Of these, use of a phenyl group is preferable. A substitutional group any such aryl group can have may be, for example, a hydroxyl group, fluorine, chlorine, bromine or other halogen atom, methyl group, ethyl group, n-propyl group, iso-propyl group, n-butyl group, tert-butyl group, iso-butyl group or other straight- or branched-chain alkyl group with 1 to 4 carbons.

More specifically, a hydrazide compound expressed by General Formula (1) above may be, for example, lauric acid hydrazide, salicylic acid hydrazide, formhydrazide, acetohydrazide, propionic acid hydrazide, p-hydroxy benzoic acid hydrazide, naphthoic acid hydrazide or 3-hydroxy-2-naphthoic acid hydrazide, among others.

Specific examples of dihydrazide compounds include those expressed by General Formula (2) below:

[Chemical Formula 2]

$$H_2NHN—X—NHNH_2 \quad (2)$$

(In the formula, X represents group-CO— or group-CO-A-CO—. A represents an alkylene group or arylene group.)

In General Formula (2) above, an alkylene group represented by A may be, for example, a methylene group, ethylene group, trimethylene group, tetramethylene group, pentamethylene group, hexamethylene group, heptamethylene group, octamethylene group, nonamethylene group, decamethylene group, undecamethylene group or other straight-chain alkylene group with 1 to 12 carbons. Examples of an arylene group include, among others, a phenylene group, biphenylene group, naphthylene group, anthrylene group and phenanthrylene group. Of these, use of a phenylene group, naphthylene group, etc., is preferable. A substitutional group any such arylene group can have may be selected from the same examples of substitutional groups cited for the aforementioned aryl group.

To be specific, a dihydrazide compound expressed by General Formula (2) above may be, for example, an oxalic acid dihydrazide, malonic acid dihydrazide, succinic acid dihydrazide, adipic acid dihydrazide, azelaic acid dihydrazide, sebacic acid dihydrazide, dodecanedioic acid dihydrazide, maleic acid dihydrazide, fumaric acid dihydrazide, diglycolic acid dihydrazide, tartaric acid dihydrazide, malic acid dihydrazide, isophthalic acid dihydrazide, terephthalic acid dihydrazide, dimeric acid dihydrazide, 2,6-naphthoic acid dihydrazide and other dibasic acid dihydrazides.

Furthermore, the various dibasic acid dihydrazide compounds described in Examined Japanese Patent Laid-open No. Hei 2-4607, and 2,4-dihydrazide-6-methyl amino-symtriazine, etc., can also be used as dihydrazides for the aforementioned purpose.

All are known substances and any appropriate commercial product can be purchased and used. Specific products include Chemcatch by Otsuka Chemical.

The greased leather is treated as follows.

The greasing step is followed by water draining (setter), hang drying and conditioning (adjustment of water content). In the vibration step, the leather is transferred onto the vibration machine where its foot, periphery and other hard areas are softened and lines generated from drum milling are removed to increase the surface area. In the drum milling step, the leather is transferred into the rotary drum to loosen the leather fibers that have been dried. In the subsequent drying, buffing and vibration step, the leather is transferred onto the fin-back machine where the milled leather is secured by toggle mechanisms and stretched, dried (on a net), and flattened. The leather is then transferred onto the vibration machine to loosen the fibers, soften the foot, periphery and other hard areas, and remove lines generated from drum milling to increase the surface area. Thereafter, the obtained product undergoes an intermediate inspection to check the grade, grains, texture, color, thickness and other items.

The natural leather obtained by the aforementioned steps has, in the natural leather, the tanning agent, re-tanning agent, dye, greasing agent, and treatment agent that confines in the natural leather the formaldehyde and acetaldehyde generating in the natural leather.

To make this natural leather into a product, a coating film is formed on the surface of natural leather in the manner explained below.

The coating step is where a coating film is formed, using a coating material, on the surface of the natural leather that has been heated after the greasing step.

A base coat layer constituted by a water-based coating agent containing pigment is coated onto the surface of the base of natural leather, a color coat layer constituted by a water-based coating agent is coated onto the aforementioned coat layer, and a top coat layer is formed on the aforementioned coat layer.

(1) Base Coat Layer

The base coat layer is the bottom layer constituting the layered coating film, used to flatten the surface irregularities of the leather and thereby prepare the leather surface for forming of stable layers on top. To form this layer, a composition constituted by resin, pigment, auxiliaries, touch agent, leveling agent and water is applied onto the leather surface. For the resin, a two-component polyurethane resin is used. For the pigment, a pigment of a desired color is used. For the auxiliaries, various agents can be used including surface active agent, thickening agent, adjustment agent and matte agent. The application method can be selected from among brushing, spraying, curtain-coating and roll-coating of an aqueous solution of the mixture, as deemed appropriate. The application amount is 70 to 150 g/m$^2$, and hot air is blown onto the coated surface to evaporate the water content. The film thickness is 20 to 50 μm.

This is followed by embossing. Embossing is a type of processing whereby concave/convex shapes are added to the leather surface using a high-pressure press so that the leather will have various patterns (grain patterns). Next, the leather goes through the drum milling step and staking step to loosen the leather fibers and adjust its texture.

(2) Color Coat Layer

A color coat is formed on the base coat surface. The color coat layer is the intermediate layer in the coating film, provided on top of the base coat formed on the leather, and the pigment/dye used to add color to the leather is contained in this layer. To form this layer, again a composition constituted by resin, pigment, auxiliaries, cross-linking agent, touch agent and water is applied onto the leather surface. For the resin, a two-component polyurethane resin is used. For the pigment, a pigment of a desired color is used. For the auxiliaries, various agents can be used including surface active agent (leveling agent, etc.), thickening agent and adjustment agent. The application method can be selected from among brushing, spraying, curtain-coating and roll-coating of an aqueous solution of the mixture, as deemed appropriate. The application amount is 20 to 70 g/m$^2$, and hot air is blown onto the coated surface to evaporate the water content. The film thickness is 5 to 25 μm.

(3) Topcoat Layer

A topcoat is formed on the color coat surface. The topcoat layer is the top layer in the coating film and adds durability such as wear resistance, good appearance (color, gloss) and touch. To form this topcoat layer, a water-based composition containing resin, cross-linking agent, delustering agent, pigment and touch agent is used. For the resin, a two-component polyurethane resin, acrylic resin, etc., can be used. The application method can be selected from among brushing, spraying, curtain-coating and roll-coating of an aqueous solution of the mixture, as deemed appropriate. The application amount is 20 to 70 g/m$^2$, and hot air is blown onto the coated surface to evaporate the water content. The film thickness is 5 to 25 μm.

The natural leather obtained by the aforementioned steps has, in the natural leather, the tanning agent, re-tanning agent, dye, greasing agent, and treatment agent that confines in the natural leather the formaldehyde and acetaldehyde generating in the natural leather, wherein a coating film constituted by three layers is formed on the surface of such natural leather.

It has been known that, depending on the coating film constituted by three layers provided on the surface of natural leather, such coating film does not inhibit or prevent formaldehyde and acetaldehyde generating in the natural leather. Accordingly, formaldehyde and acetaldehyde generating from the natural leather formed by the aforementioned steps were checked. The results were used to evaluate if the natural leather treated by the series of steps until greasing, according to the present invention, can inhibit or prevent formaldehyde and acetaldehyde from breaking free and separating from/coming out of the natural leather as a result of breakdown of any substance taken into or already present in the natural leather.

The natural leather manufactured through the aforementioned steps was tested by the method explained below to check if generation of formaldehyde and acetaldehyde would be measured.

Formaldehyde and acetaldehyde were analyzed using the Tedlar bag method.

Under the Tedlar bag method, the sample leather is cut to the size of 1 DS (10 cm×10 cm) and put in a Tedlar bag, after which nitrogen is charged and the bag is sealed. The bag is then heated to cause aldehydes to volatilize from the leather. In this condition, a pump is used to suction the gas out of the bag and let aldehydes be adsorbed by a special dinitrophenyl hydrazide (DNPH) cartridge.

The adsorbed substances are then eluted using acetonitrile and the obtained solution is measured by high-speed liquid chromatography.

According to the measurements obtained so far, a natural leather treatment agent containing a greasing agent along with sodium hydrogen sulfite resulted in adsorption of up to 0.709 μg/DS of formaldehyde and up to 2.379 μg/DS of acetaldehyde, while a natural leather treatment agent containing a greasing agent along with sodium hydrogen sulfite and hydrazide compound resulted in adsorption of up to 0.230 μg/DS of formaldehyde and up to 0.232 μg/DS of acetaldehyde.

Example 1

(1) Tanning Agent Remaining in the Natural Leather (i) Amount remaining in the natural leather of a tanning agent using a formaldehyde condensation product of naphthalene sulfonic acid (2 parts by weight relative to 100 parts by weight of natural leather)

(ii) Amount of a chromium tanning agent remaining in the natural leather (3 parts by weight (as chromium oxide) relative to 100 parts by weight of natural leather)

(iii) Amount of a resin tanning agent remaining in the natural leather (3 parts by weight relative to 100 parts by weight of natural leather)

(2) Dye

Dye (containing carbon black)

Amount of a carbon black dye remaining in the natural leather (2 parts by weight relative to 100 parts by weight of natural leather)

The natural leather treatment agent for use in the greasing step contains a greasing agent as well as a trapping agent or fixing agent for confining in the natural leather the formaldehyde and acetaldehyde generating in the natural leather.

Natural Leather Treatment Agent for Use in the Greasing Step of Natural Leather

Conditions of Natural Leather Treatment Agent

Treatment temperature: 50 to 60° C.

pH: 5

The greasing agent, and the trapping agent or fixing agent for containing in the natural leather the formaldehyde and acetaldehyde generating in the natural leather, used in amounts relative to 100 parts by wet weight of the chromium-tanned leather (wet blue), are as follows:

| (1) Greasing agent | |
|---|---|
| Greasing agent used | Fatty acid soap |
| Amount of greasing agent used | 4.0 (parts by weight) |
| (2) Trapping agent or fixing agent for confining in the natural leather the formaldehyde and acetaldehyde generating in the natural leather | |
| Sodium hydrogen sulfite | 1 (part by weight) |
| Adipic acid dihydrazide | 0.5 (part by weight) |
| (3) Water | 150 (parts by weight) |

Ratio of Natural Leather Treatment Agent Used and Leather (Parts by Weight)

| | |
|---|---|
| Leather | 100 |
| Natural leather treatment agent | 4 (parts by weight) |
| Greasing agent considered to be actually remaining in the natural leather | 2.8 (parts by weight) |
| Sodium hydrogen sulfite considered to be actually remaining in the natural leather | 0.7 (part by weight) |
| Adipic acid dihydrazide considered to be actually remaining in the natural leather | 0.3 (part by weight) |

A coating film constituted by a base coat layer, color coat layer and topcoat layer, each made of a two-component aliphatic polyurethane, was formed on the natural leather obtained under the aforementioned conditions, by spray coating over the entire surface.

Analysis Results

The treated leather thus obtained was evaluated by the Tedlar bag method to analyze the generated amounts of formaldehyde and acetaldehyde, the results of which are as follows:

| | |
|---|---|
| Concentration of formaldehyde generated from the leather (μg/DS) | 0.277 |
| Concentration of acetaldehyde generated from the leather (μg/DS) | 0.604 |

Example 2

All conditions are the same as those used in Example 1, except for the following

| (2) Treatment agent that confines in the natural leather the formaldehyde and acetaldehyde generating in the natural leather | |
|---|---|
| Sodium hydrogen sulfite | 1 |
| Adipic acid dihydrozide | 1 |

Analysis Results

The treated leather thus obtained was evaluated by the Tedlar bag method to analyze the generated amounts of formaldehyde and acetaldehyde, the results of which are as follows:

| | |
|---|---|
| Concentration of formaldehyde generated from the leather (μg/DS) | 0.247 |
| Concentration of acetaldehyde generated from the leather (μg/DS) | 0.343 |

Example 3

All conditions are the same as those used in Example 1, except for the following

| (2) Treatment agent that confines in the natural leather the formaldehyde and acetaldehyde generating in the natural leather | |
|---|---|
| Sodium hydrogen sulfite | 1 (part by weight) |
| Adipic acid dihydrozide | 2 (parts by weight) |

Analysis Results

The treated leather thus obtained was evaluated by the Tedlar bag method to analyze the generated amounts of formaldehyde and acetaldehyde, the results of which are as follows:

| | |
|---|---|
| Concentration of formaldehyde generated from the leather (μg/DS) | 0.230 |
| Concentration of acetaldehyde generated from the leather (μg/DS) | 0.232 |

Comparative Example 1

All conditions are the same as those used in Example 1, except for the following

| (2) Treatment agent that confines in the natural leather the formaldehyde and acetaldehyde generating in the natural leather | |
|---|---|
| Sodium hydrogen sulfite | 1 (part by weight) |
| Adipic acid dihydrozide | 0 |

Analysis Results

The treated leather thus obtained was evaluated by the Tedlar bag method to analyze the generated amounts of formaldehyde and acetaldehyde, the results of which are as follows:

| | |
|---|---|
| Concentration of formaldehyde generated from the leather (μg/DS) | 0.709 |
| Concentration of acetaldehyde generated from the leather (μg/DS) | 2.479 |

Comparative Example 2

Blank Test

| (2) Treatment agent that confines in the natural leather the formaldehyde and acetaldehyde generating in the natural leather | |
|---|---|
| Sodium hydrogen sulfite | 0 |
| Adipic acid dihydrozide | 0 |

Analysis Results

The treated leather thus obtained was evaluated by the Tedlar bag method to analyze the generated amounts of formaldehyde and acetaldehyde, the results of which are as follows:

| | |
|---|---|
| Concentration of formaldehyde generated from the leather (μg/DS) | 2.669 |
| Concentration of acetaldehyde generated from the leather (μg/DS) | 1.706 |

The above results are organized in Table 1.

TABLE 1

| | Comparative Example 1 | Comparative Example 2 | Example 1 | Example 2 | Example 3 |
|---|---|---|---|---|---|
| Sodium hydrogen sulfite (percent by weight) | 1 | 0 | 1 | 1 | 1 |
| Adipic acid dihydrazide (percent by weight) | 0 | 0 | 0.5 | 1 | 2 |
| Concentration of formaldehyde generated from the leather (μg/DS) | 0.709 | 2.669 | 0.277 | 0.247 | 0.23 |
| Concentration of acetaldehyde generated from the leather (μg/DS) | 2.379 | 1.706 | 0.604 | 0.343 | 0.232 |

As shown, generation of formaldehyde was inhibited in Comparative Example 1.

In Example 1 where dihydrazide was used, generation of formaldehyde and acetaldehyde was inhibited.

Results of Examples 2 and 3 show that increasing the added amount of dihydrazide would inhibit generation of formaldehyde and acetaldehyde more effectively.

Example 4

Natural leather was treated in the same manner as in Examples 1 to 3 mentioned above, except that phosphorylated oil was used as a greasing agent, and the same results were obtained.

| (1) Greasing agent | |
|---|---|
| Greasing agent used | Phosphorylated oil |
| Amount of greasing agent used | 4.0 (parts by weight) |

Example 5

Natural leather was treated in the same manner as in Examples 1 to 3 mentioned above, except that a nonionic greasing agent was used, and the same results were obtained.

| (1) Greasing agent | |
|---|---|
| Greasing agent used | Nonionic greasing agent |
| Amount of greasing agent used | 4.0 (parts by weight) |

Example 6

Natural leather was treated in the same manner as in Examples 1 to 3 mentioned above, except that vegetable oil was used as a greasing agent, and the same results were obtained.

| (1) Greasing agent | |
|---|---|
| Greasing agent used | Vegetable oil |
| Amount of greasing agent used | 4.0 (parts by weight) |

Example 7

Natural leather was treated in the same manner as in Examples 1 to 3 mentioned above, except that sulfited oil was used as a greasing agent, and the same results were obtained.

| (1) Greasing agent | |
|---|---|
| Greasing agent used | Sulfited oil |
| Amount of greasing agent used | 4.0 (parts by weight) |

Example 8

Natural leather was treated in the same manner as in Examples 1 to 3 mentioned above, except that sulfated oil was used as a greasing agent, and the same results were obtained.

| (1) Greasing agent | |
|---|---|
| Greasing agent used | Sulfated oil |
| Amount of greasing agent used | 4.0 (parts by weight) |

INDUSTRIAL APPLICATION OF USE

The present invention discusses a natural leather used for car seats and automobile interior parts. The natural leather for preventing generation of formaldehyde and acetaldehyde, as proposed by the present invention, can also be utilized in place of natural leathers applied for general products, to prevent generation of formaldehyde and acetaldehyde.

The invention claimed is:

1. A greasing agent for use in a greasing step of the manufacture of natural leather, said greasing agent being comprised of a greasing agent body selected from the group consisting of an anionic greasing agent, cationic greasing agent, amphoteric greasing agent, and nonionic greasing agent, and a hydrazide compound as a treatment agent for inhibiting generation of formaldehyde and acetaldehyde from the natural leather, wherein a ratio of the treatment agent to the greasing agent body is (0.5 to 3)/(1 to 8) by weight.

2. A greasing agent according to claim 1 for use in the greasing step for natural leather, wherein the hydrazide compound is adipic acid dihydrazide.

3. A greasing agent for use in a greasing step of the manufacture of natural leather, said greasing agent being comprised of a greasing agent body selected from the group consisting of an anionic greasing agent, cationic greasing agent, amphoteric greasing agent, and nonionic greasing agent, and a hydrazide compound and sodium hydrogen sulfite as a treatment agent for inhibiting generation of formaldehyde and acetaldehyde from the natural leather, wherein a ratio of the treatment agent to the greasing agent body is (0.5 to 3)/(1 to 8) by weight.

4. A greasing agent according to claim 3 for use in the greasing step for natural leather, wherein the hydrazide compound is adipic acid dihydrazide.

5. A natural leather treated by a tanning agent, re-tanning agent, dye, and greasing agent, said natural leather being impregnated with a hydrazide compound as a treatment agent in an amount effective to inhibit generation of formaldehyde and acetaldehyde from the natural leather, said hydrazide compound being taken into the natural leather together with the greasing agent, wherein the amount of the treatment agent taken into the natural leather is 0.35 to 2.1 parts by weight per 100 parts by weight of shaved leather for the natural leather.

6. A natural leather according to claim 5, wherein the hydrazide compound is adipic acid dihydrazide.

7. A natural leather according to claim 5, wherein a coating film is formed on the surface of the natural leather.

8. An automobile interior part being covered with a natural leather according to claim 7.

9. An automobile seat being covered with a natural leather according to claim 7.

10. A natural leather treated by a tanning agent, re-tanning agent, dye, and greasing agent, said natural leather being impregnated with a hydrazide compound and sodium hydrogen sulfite as a treatment agent in an amount effective to inhibit generation of formaldehyde and acetaldehyde from the natural leather, said hydrazide compound being taken into the natural leather together with the greasing agent, wherein the amount of the treatment agent taken into the natural leather is 0.35 to 2.1 parts by weight per 100 parts by weight of shaved leather for the natural leather.

11. A natural leather according to claim 10, wherein the hydrazide compound is adipic acid dihydrazide.

12. A natural leather according to claim 10, wherein a coating film is formed on the surface of the natural leather.

13. An automobile interior part being covered with a natural leather according to claim 12.

14. An automobile seat being covered with a natural leather according to claim 12.

* * * * *